US005778905A

United States Patent [19]

Adam

[11] Patent Number: 5,778,905

[45] Date of Patent: Jul. 14, 1998

[54] VOLUME HAIRPIN

[76] Inventor: Helen Koshaba Adam, 2420 Meadow, Rue Modesto, Calif. 95355

[21] Appl. No.: 742,177

[22] Filed: Oct. 30, 1996

[51] Int. Cl.[6] ..... A45D 8/06

[52] U.S. Cl. ..... 132/284; 132/54; 24/555; 24/556

[58] Field of Search ..... 132/276, 280, 132/281, 284, 273, 53; 24/555, 556, 552, 546

[56] References Cited

U.S. PATENT DOCUMENTS

| | | | |
|---|---|---|---|
| 664,885 | 1/1901 | McGrath | 24/546 |
| 727,347 | 5/1903 | Glover | 24/552 |
| 958,339 | 5/1910 | Watson | 132/281 |
| 1,341,980 | 6/1920 | Hayman | 132/280 |
| 1,362,824 | 12/1920 | Schulze et al. | 132/281 |
| 1,675,806 | 7/1928 | Holden | 132/276 |
| 2,401,620 | 6/1946 | De Julio | 132/280 |
| 2,531,854 | 11/1950 | Linden | 132/284 |
| 3,677,270 | 7/1972 | Goodman | 132/276 |
| 3,930,511 | 1/1976 | Roney | 132/50 |
| 5,251,650 | 10/1993 | Edmark | 132/281 |

FOREIGN PATENT DOCUMENTS

| | | | |
|---|---|---|---|
| 228678 | 1/1910 | Germany | 132/280 |
| 123523 | 6/1931 | Germany | 24/555 |

*Primary Examiner*—Todd E. Manahan
*Assistant Examiner*—E. Robert
*Attorney, Agent, or Firm*—Steve A. Wong

[57] ABSTRACT

A hairpin which gives hair the appearance of greater volume and thickness by using a support member which protrudes from the side of the lower leg of the hairpin at an acute angle and which extends substantially parallel to the legs of the hairpin. Hairs being held between the legs of the hairpin are elevated by the support member to a position above the upper leg of the pin and away from the scalp, thus giving the appearance of fuller, thicker hair.

7 Claims, 2 Drawing Sheets

VOLUME HAIRPIN

BACKGROUND

This invention relates to a hairpin which is used to give hair the appearance of greater volume and thickness. It can also be used to help shape the hair in a particularly desired fashion.

Hairpins are generally used to clip numerous strands of hair together, to hold the hair onto the scalp or to attach a hairpiece to one's own hair. Using standard hairpins to hold hair generally give the hair a tight and compact appearance. Thus, the function of standard hairpins are limited with regards to giving the wearer the appearance of a fuller, thicker head of hair.

SUMMARY

This invention can not only accomplish the functions of standard hairpins but can also help enhance the attractiveness of hair by giving it the fuller appearance of more volume, thickness and density. This invention can help cover up balding areas on the scalp due to balding or hair thinning by shaping hair surrounding the problem area over the thinning or balding spot.

The design is effective yet simple and easy to use, light in weight, and low in cost. It is available in many colors to match the color of the wearer's hair so as to make the hairpin inconspicuous to admirers. It also provides an advantage to those with thinning or balding hair problems who resort to surgery or hair growth chemicals as it does not use chemicals to damage existing hair or irritate scalp and is obviously not as expensive, intrusive or risky as surgery. This invention is ideal for those who have little time to spend on their hair but want to look their best.

This invention accomplishes the foregoing objectives by using an additional support member which protrudes from the side of the lower leg of the hairpin. This support member runs substantially parallel to the legs of the hairpin and is angled upward at an acute angle such that hairs being held between the legs of the hairpin are elevated to a position above the top of the pin and away from the scalp, as the lower leg of the hairpin is always positioned closest to the scalp. Since the hairs are held out and away from the scalp rather than flatly and tightly against the scalp, the hair appears to be fuller and thicker. A wearer can use this invention in lieu of hair spray or curling irons to attain the full-bodied look.

This invention can also help cover up areas of thinning hair on the scalp or balding spots. The hairpin can be placed on hair surrounding the problem area to as to position the hair being elevated by the support member over or towards the problem areas.

BRIEF DESCRIPTION OF THE DRAWINGS

The features, advantages, and objects of the present invention will become apparent from the following detailed description of a preferred embodiment thereof, taken in conjunction with the accompanying drawings in which.

DESCRIPTION

Figure 1:
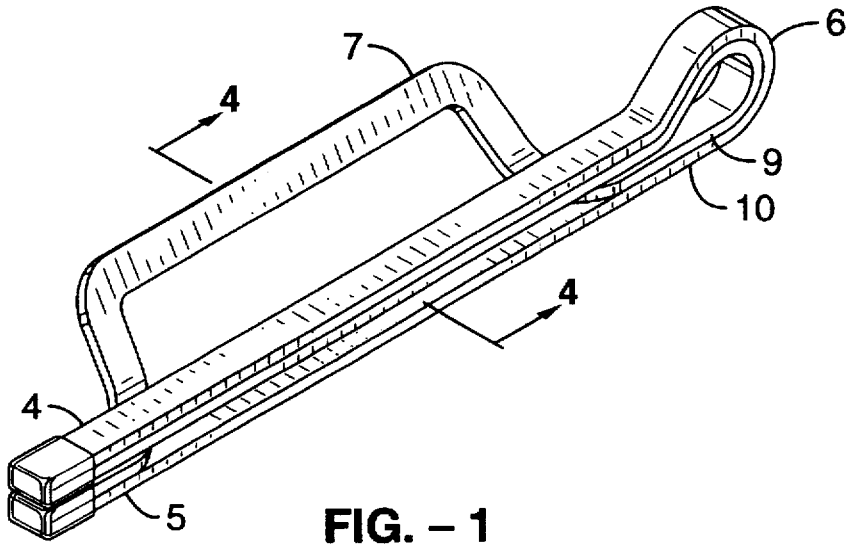
FIG. 1 is a perspective view of the volume hair pin with the support member on the right side.

FIG. 1 illustrates the preferred embodiment of the invention. The upper leg 4 of the hairpin is connected to the lower leg 5 by the loop 6. The support member 7 protrudes from the side of the lower leg 5. Upper leg 4 and lower leg 5 have ends that touch one another or are in substantially close proximity such that a layer of hair can be grasped between upper leg 4 and lower leg 5.

Figure 2:
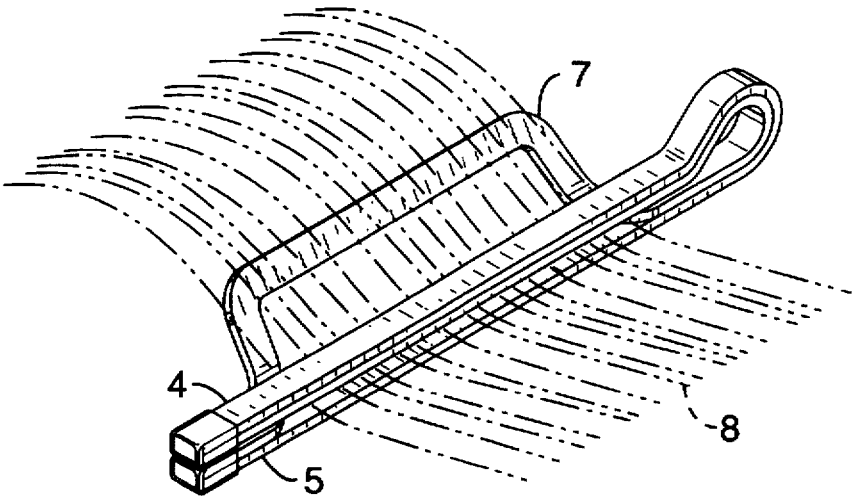
FIG. 2 is a view of the volume hairpin showing the manner which hair is held and supported by the pin.

FIG. 2 illustrates the manner in which hairs 8 being held by the pin flow between the upper leg 4 and lower leg 5 and over the support member 7. Thus, the hairs are held in a position above the upper leg 4. The bottom side of the lower leg 5 is always worn towards the scalp.

In the preferred embodiment of the invention, the entire pin is fabricated from a circular strip of resilient material pressed together to form essentially a linear strip of two bands 9 and 10, one above the other. The linear strip is folded over at approximately its midway point forming the loop 6 and the upper leg 4 and lower leg 5. Both legs are contiguous to each other such that hairs can be held tightly between the legs. The resilient nature of the material allow the legs to be spread apart to ease placement of hairs between them. The upper band 9 of the lower leg 5 protrudes outward to the side of the lower leg 5 forming the support member 7. The plane formed by the lower leg 5 and the support member 7 lies at an acute angle with the plane formed by the upper leg 4 and the lower leg 5. The angle of the support member 7 can be adjusted to achieve a desired result by bending the support member 7 upwards or downwards. The support member 7 can protrude either to the left or right of the lower leg 5. For enhanced durability, the hairpin is coated with a wax-like material to keep the bands tightly together.

Figure 3:
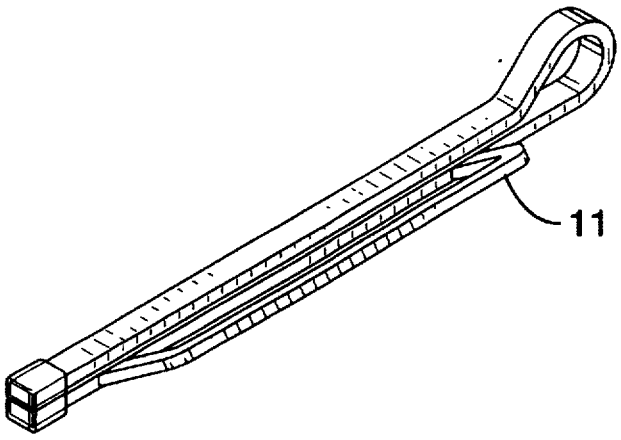
FIG. 3 is a perspective view of the volume hair pin with the support member on the left side.

FIG. 3 illustrates the hairpin in which the support member 11 is attached to a hairpin by any commonly known method.

Figure 4:
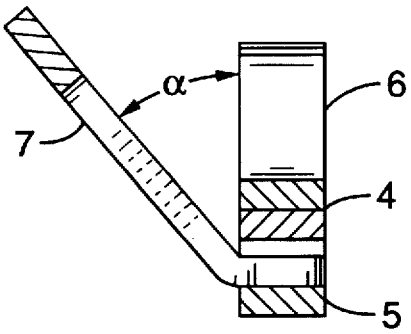
FIG. 4 is a cross-sectional view of the hairpin shown in FIG. 1 taken along line 4—4.

FIG. 4 shows the cross section of the hairpin depicted in FIG. 1. The plane formed by support member 7 is at an acute angle ox relative to the plane formed by the upper leg 4 and the lower leg 5. Loop 6 connects the upper leg 4 to lower leg 5. Support member 7 extends outwardly from lower leg 5 such that hairs held between upper leg 4 and lower leg 5 flow over support member 7 and to a position above upper leg 4. The bottom side of lower leg 5 is always worn towards the scalp.

What is claimed is:

1. A hairpin which gives an appearance of greater volume and thickness to hair, comprising:

(a) an upper leg including an end, (b) a lower leg extending substantially parallel with the upper leg whereby hairs can be grasped between the upper and lower legs, the lower leg including an end which touches the end of the upper leg;

(c) a loop at one end of the hairpin which connects the upper leg and the lower leg; and (d) a support member protruding outward from the lower leg at an acute angle, the support member positioned distal to the upper leg whereby hairs grasped between the upper and lower legs are elevated by the support member to a position above the upper leg.

2. A hairpin as recited in claim 1, wherein the hairpin is formed by a circular strip of resilient material pressed together resulting in a linear strip of two bands in a contiguous relationship whereby the linear strip is folded over onto itself to form the loop and the legs, and only one of the bands of the lower leg is the support member which protrudes outward.

3. A hairpin as recited in claim 1, wherein the support member protruding outward comprises a piece of material attached to the lower leg of the hairpin.

4. A hairpin which gives hair an appearance of greater volume and thickness, comprising a strip of resilient material folded over onto itself to form a loop at one end and an upper leg and a lower leg extending from the loop, the upper leg and the lower leg each including ends that touch one another, the upper and lower leg extending substantially parallel to each other and forms a vertical plane of the hairpin, wherein the lower leg comprises a support member protruding from one side and forms a second plane at an acute angle to the vertical plane, the support member being positioned distal to the upper leg.

5. A hairpin as recited in claim 4, wherein the strip of resilient material is formed by a continuous circular strip of resilient material pressed compactly together resulting in a linear strip of two bands in a contiguous relationship, whereby the linear strip is folded over onto itself to form the loop and the legs, and one of the bands of the lower leg is the support member protruding outward.

6. A hairpin as claimed in claim 4 wherein the support member protruding outward comprises a piece of material attached to the lower leg of the hairpin.

7. A means for giving hair in a hairpin an appearance of greater volume and thickness, comprising a hairpin with two legs connected by a loop wherein a support member protrudes at an acute angle from a leg of the hairpin such that the hairs grasped between the legs are elevated by the support member to a position further away from the scalp, the support member protruding from the leg worn closest to the scalp and the legs including ends that touch one another.

* * * * *